US005718042A

United States Patent [19]

Maejima

[11] Patent Number: 5,718,042

[45] Date of Patent: Feb. 17, 1998

[54] TERMINAL INSERTION METHOD

[75] Inventor: Takamichi Maejima, Shizuoka, Japan

[73] Assignee: Yazaki Corporation, Tokyo, Japan

[21] Appl. No.: 744,076

[22] Filed: Nov. 4, 1996

[30] Foreign Application Priority Data

Nov. 7, 1995 [JP] Japan ..... 7-288557

[51] Int. Cl.[6] ..... H01R 43/20

[52] U.S. Cl. ..... 29/881; 29/33 M; 29/754; 29/861

[58] Field of Search ..... 29/881, 861, 33 M, 29/754

[56] References Cited

U.S. PATENT DOCUMENTS

| | | | |
|---|---|---|---|
| 5,083,370 | 1/1992 | Koch et al. | 29/863 |
| 5,127,189 | 7/1992 | Kudo et al. | 29/861 X |
| 5,208,977 | 5/1993 | Ricard | 29/861 |
| 5,315,756 | 5/1994 | Jurjevie et al. | 29/33 M |
| 5,355,583 | 10/1994 | Osumi et al. | 29/33 M |
| 5,414,925 | 5/1995 | Nishide et al. . | |
| 5,477,607 | 12/1995 | Ohta et al. | 29/33 M |
| 5,515,601 | 5/1996 | Maejima | 29/33 M |
| 5,575,058 | 11/1996 | Nakamura et al. | 29/33 M |
| 5,615,478 | 4/1997 | Celoudoux et al. | 29/33 M |

FOREIGN PATENT DOCUMENTS

| | | |
|---|---|---|
| 7-296937 | 11/1995 | Japan . |
| 8-124647 | 5/1996 | Japan . |

*Primary Examiner*—Carl J. Arbes

*Attorney, Agent, or Firm*—Armstrong, Westerman, Hattori, McLeland & Naughton

[57] ABSTRACT

Terminal insertion methods for preventing a terminal and a connector housing from being broken in the event that a secondary insertion fails. The distance from a rear end of a terminal to secondary insertion claws, which are behind primary insertion claws, is set approximately to the required insertion stroke. When the terminal interferes with the connector housing during the secondary insertion process, a wire between the rear end of the terminal and the rear insertion claws is made to buckle to release an overload acting on the terminal and connector housing. A primary chuck cylinder for the front insertion claws is connected to a rod of a primary insertion cylinder; the primary chuck cylinder is secured to a guide plate; a secondary insertion cylinder 10 is secured to the guide plate; and a secondary chuck cylinder for the rear insertion claws is connected to a rod of the secondary insertion cylinder. In the terminal insertion apparatus of the above construction, the pressure of the primary insertion cylinder is set smaller than that of the secondary insertion cylinder so as to release the overload, which is produced when the terminal interferes with the connector housing during the secondary insertion process, to the primary insertion cylinder.

5 Claims, 7 Drawing Sheets

TERMINAL INSERTION METHOD

BACKGROUND OF THE INVENTION

1. Field of the Invention

The present invention relates to a terminal insertion method which prevents breakage of terminals and a connector housing in the event of a second-step insertion failure by utilizing a buckling action of a wire or a pressure difference between two insertion cylinders used to insert terminals in two steps.

2. Description of the Related Art

FIG. 8 shows a terminal insertion apparatus proposed by the applicant of this invention in Japanese Patent Application No. Heisei 6-262240. This apparatus 31 has securely fixed on a movable base 34 a connector receiver 33 to which connector housing 32 is inserted. The movable base 34 is mounted to a stationary base 35 through an air cylinder 36 so that it is slidable in the direction of terminal insertion. The movable base 34 can be slid along a guide rail 43 of the stationary base 35. The air cylinder 36 urges the movable base 84 in a direction opposite the terminal insertion direction.

A terminated wire 87 is gripped with a pair of front insertion claws 40 and a pair of rear insertion claws 41. First, the front end portion of a terminal 88 is inserted into a connector housing 32 by the front insertion claws 40 in a primary insertion action. Then, the front insertion claws 40 are opened and the rear insertion claws 41 push the wire portion 39 toward the front to insert the entire terminal into the connector housing 32 in a secondary insertion action. When the front end of the terminal abuts against the rear end of the connector housing 32 or catches a resilient terminal engagement lance 42 inside the connector housing, producing an excess force (about 2.5–3 kgf) acting on the connector housing 32 in the insertion direction, the air cylinder 38 contracts to allow the connector housing 32 to escape in the forward direction, thus preventing the terminal 38 and the connector housing 32 from being broken.

The above-mentioned conventional structure, however, has a drawback that it is necessary to set the biasing pressure of the air cylinder 38, i.e., overload value, according to the size of the terminal 38 and the wire portion 39, which is troublesome.

SUMMARY OF THE INVENTION

It is an object of this invention to provide a terminal insertion means which can reliably prevent damages to a terminal and a connector housing in the event of a terminal secondary-insertion failure, without requiring the overload value, such as the biasing pressure of the air cylinder, to be changed according to the size of the terminal and wire.

In order to attain the object, according to this invention, there are provided a first terminal insertion method and a second terminal insertion method.

The first terminal insertion method comprises: gripping a wire with a terminal with front and rear insertion claws; inserting a front end portion of the terminal into a connector housing in a primary insertion step; and inserting the whole terminal into the connector housing with the rear insertion claws in a secondary insertion step, wherein a distance from a rear end of the terminal to the rear insertion claws is set slightly greater than the stroke of the rear insertion claws required for inserting the whole terminal into the connector housing in the secondary insertion step, and when the terminal interferes with the connector housing during the secondary insertion step, the wire between the rear end of the terminal and the rear insertion claws is made to buckle to release an overload acting on the terminal and the connector housing.

The second terminal insertion method employs a terminal insertion apparatus which comprises: front and rear insertion claws with which a wire with a terminal is gripped; a primary chuck cylinder for opening and closing the front insertion claws; a primary insertion cylinder having a rod thereof connected to the primary chuck cylinder; a secondary chuck cylinder for opening and closing the rear insertion claws; a secondary insertion cylinder having a rod thereof connected to the secondary chuck cylinder; and a guide plate having both the primary chuck cylinder and the secondary insertion cylinder secured thereto, wherein the secondary chuck cylinder is movable independently of the primary chuck cylinder, said method comprising the step of setting a pressure of the primary insertion cylinder smaller than that of the secondary insertion cylinder so that an overload acting on a terminal and a connector housing when the terminal interferes with the connector housing during a secondary insertion step is released to the primary insertion cylinder.

The terminal insertion methods of this invention are intended to prevent the terminal and the connector housing from being broken in the event of a terminal insertion failure in the terminal insertion apparatus proposed by the applicant of this invention in Japanese Patent Application No. Heisei 6-89507. The first terminal insertion method utilizes the buckling of a wire between the terminal and the insertion claws to absorb an impact force produced in the event of an insertion failure during the course of inserting the terminal into the connector housing by gripping the terminated wire with insertion claws of a terminal insertion head.

The second terminal insertion method comprises the steps of: performing a primary insertion of a front end portion of the terminal by moving first insertion claws and second insertion claws simultaneously in the terminal insertion direction by the primary insertion cylinder, the primary insertion claws being adapted to grip the wire immediately after the terminal and the secondary insertion claws being adapted to grip the wire behind the primary insertion claws; then performing a secondary insertion of the terminal as a whole by moving only the secondary insertion claws in the terminal insertion direction by the secondary insertion cylinder; wherein the pressure of the primary insertion cylinder is set smaller than the pressure of the secondary insertion cylinder to allow the force of the terminal impact to escape toward the primary insertion cylinder.

The above and other objects, features and advantages of this invention will become apparent from the following description and the appended claims, taken in conjunction with the accompanying drawings in which like parts or elements are denoted by like reference characters.

DESCRIPTION OF THE PREFERRED EMBODIMENTS

Now, example embodiments of the present invention will be described in detail by referring to the accompanying drawings.

Figure 1:
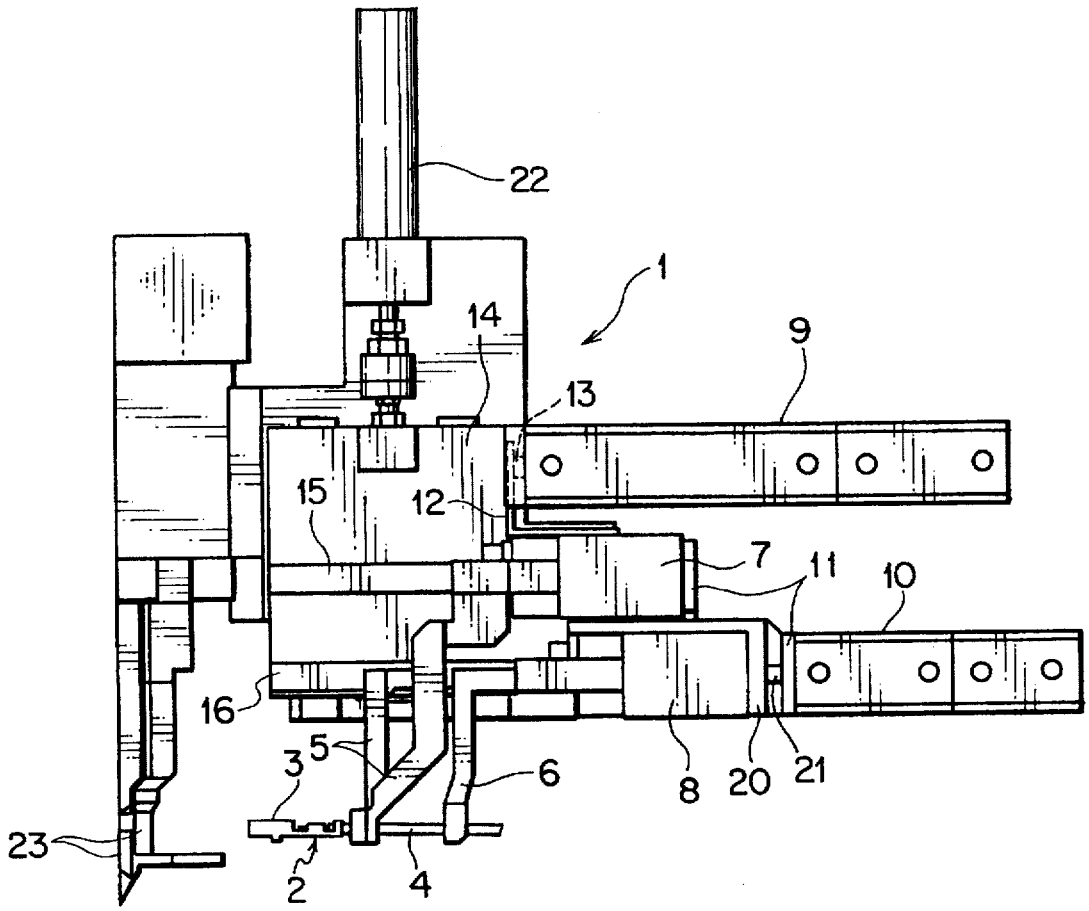
FIG. 1 is a side view showing the terminal insertion apparatus used in the terminal insertion method of this invention.

FIG. 1 shows the above-mentioned terminal insertion apparatus.

The terminal insertion apparatus (insertion head) 1 has a pair of primary insertion claws 5 and a pair of secondary insertion claws 6 to grip the terminated wire 2; a pneumatic primary chuck cylinder 7 to open and close the primary insertion claws 5; a secondary chuck cylinder 8 to open and close the secondary insertion claws 6; a pneumatic primary insertion cylinder 9 connected to the primary chuck cylinder 7 to move the primary insertion claws 5 and the secondary insertion claws 8 at the same time in the horizontal direction (the terminal insertion direction); and a pneumatic secondary insertion cylinder 10 moved together with the insertion claws 5, 8 by the primary insertion cylinder 9, which cylinder moves only the secondary insertion claws 8 in the horizontal direction.

Figure 2:
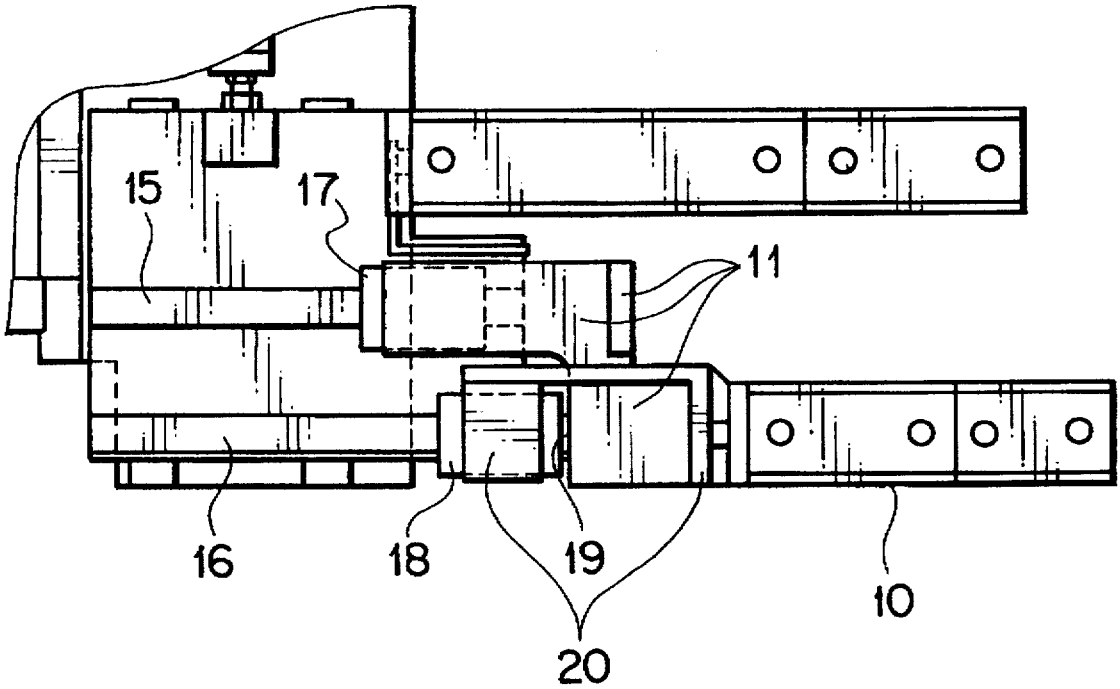
FIG. 2 is a side view showing a mounting portion of each chuck cylinder of insertion claws.

The primary chuck cylinder 7 for the primary insertion claws 5 is secured to a substantially L-shaped guide plate 11 (see FIG. 2) and connected to a rod 13 of the primary insertion cylinder 9 through an L-shaped stay 12. The primary insertion cylinder 9 is secured to a base plate 14, which also has an upper guide rail 15 and a lower guide rail 16 secured horizontally thereto. The guide plate 11 is slidably mounted on two guide rails 15, 16 through slide blocks 17, 19 (see FIG. 2).

The secondary chuck cylinder 8 for the secondary insertion claws 6 is connected through a holder 20 (FIG. 2) to a front lower slide block 18, and the rear part of the holder 20 is connected to a rod 21 of the secondary insertion cylinder 10. The secondary insertion cylinder 10 is fixed to the guide plate 11 together with the lower rear slide block 19. The front slide block 18 has the holder 20 secured thereto and can be slid back and forth along the lower guide rail 16 by the secondary insertion cylinder 10 independently of the rear slide block 19. Hence, the secondary insertion claws 6 are moved together with the primary insertion claws 5 the same stroke simultaneously by the primary insertion cylinder 9 and are moved independently of the primary insertion claws 5 by the secondary insertion cylinder 10.

Figure 6:
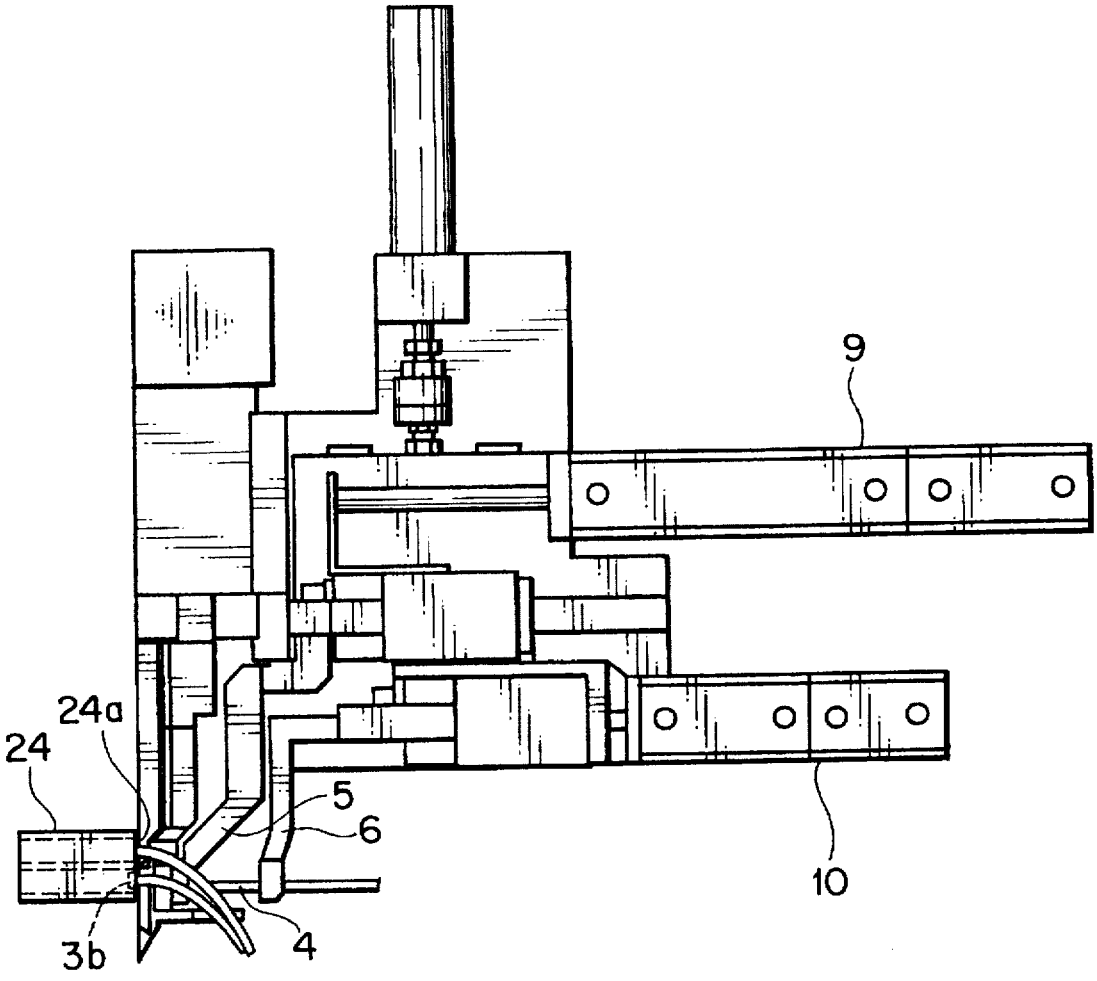
FIG. 6 is a side view showing the apparatus in the primary insertion process of inserting the terminal by the primary insertion cylinder.

The base plate 14 can be moved up and down by a vertical raise/lower cylinder 22, and the insertion claws 5, 6 receive the terminated wire 2 from a clip below (not shown). In front of the primary insertion claws 5 is provided a pair of wire clearing claws 23 that can be opened and closed. The terminal 3 is advanced between the wire clearing claws 23 by the raise/lower cylinder 22 and inserted into the connector housing 24 (FIG. 6).

Figure 3:
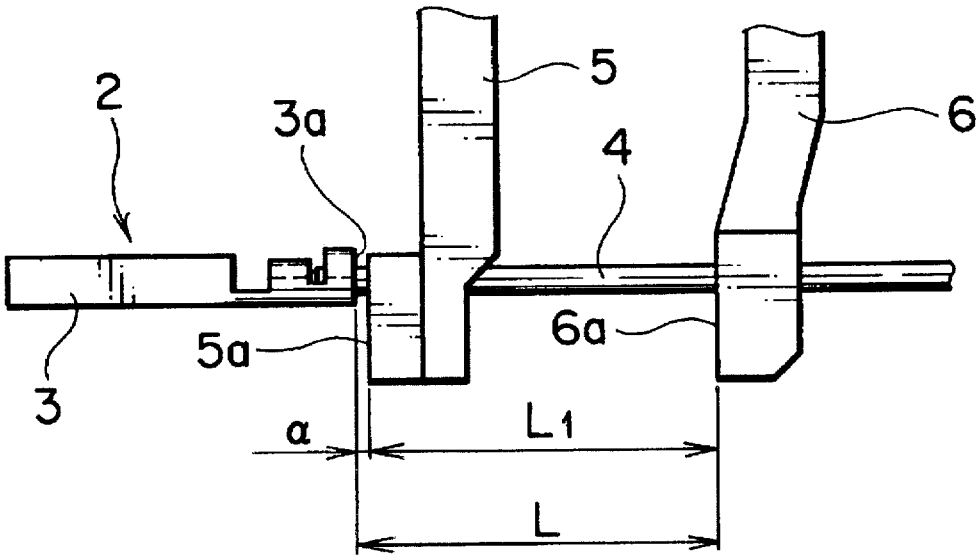
FIG. 3 is a partial side view showing a terminated wire gripped by the insertion claws.

FIG. 3 shows the terminated wire 2 gripped by the front and rear insertion claws 5, 6. In this example, the distance L from the rear end 3*a* (rear end of the rear crimping piece) of the terminal 3 to the front end 6*a* of the secondary insertion claws 6 is set to 19–31 mm according to the kind of the terminal 3 and the connector housing 24. The dimension L of 19–31 mm is a distance L1 (18–30 mm) from the front end 5*a* of the primary insertion claws 5 to the front end 6*a* of the secondary insertion claws 6 plus a margin δ (1 mm).

Figure 4:
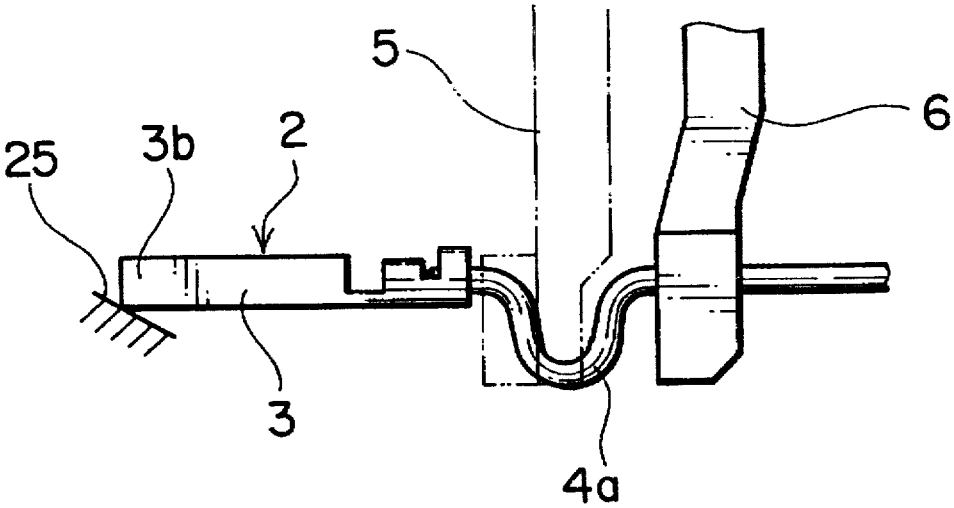
FIG. 4 is a partial side view showing the wire in a buckled state.

The distance L1 of 18–30 mm substantially coincides with the stroke of the secondary insertion claws 6 required for inserting the entire terminal 3 in position in the connector housing 24 in the secondary insertion process, which stroke is determined by the kind of the terminal 3 and the connector housing 24. The margin δ of 1 mm is designed to prevent interference between the primary insertion claws 5 and the terminal 3 when the wire 4 is gripped with the primary insertion claws 5 and also prevent interference between the wire clearing claws 23 and the wire 4 by minimizing a slack 4*a* of the wire 4 when the wire 4 is buckled during the second insertion process as shown in FIG. 4. The reason that the distance L1 has a large dimension 18–30 mm is that the stroke can be adjusted in two steps by a dual cylinder 9. In FIG. 4, reference numeral 25 represents an interfering object such as a resilient locking lance in the connector housing 24. The primary insertion claws 5 are open releasing the wire 4 and only the secondary insertion claws 6 hold and push the terminated wire 2 forwardly.

Figure 5:
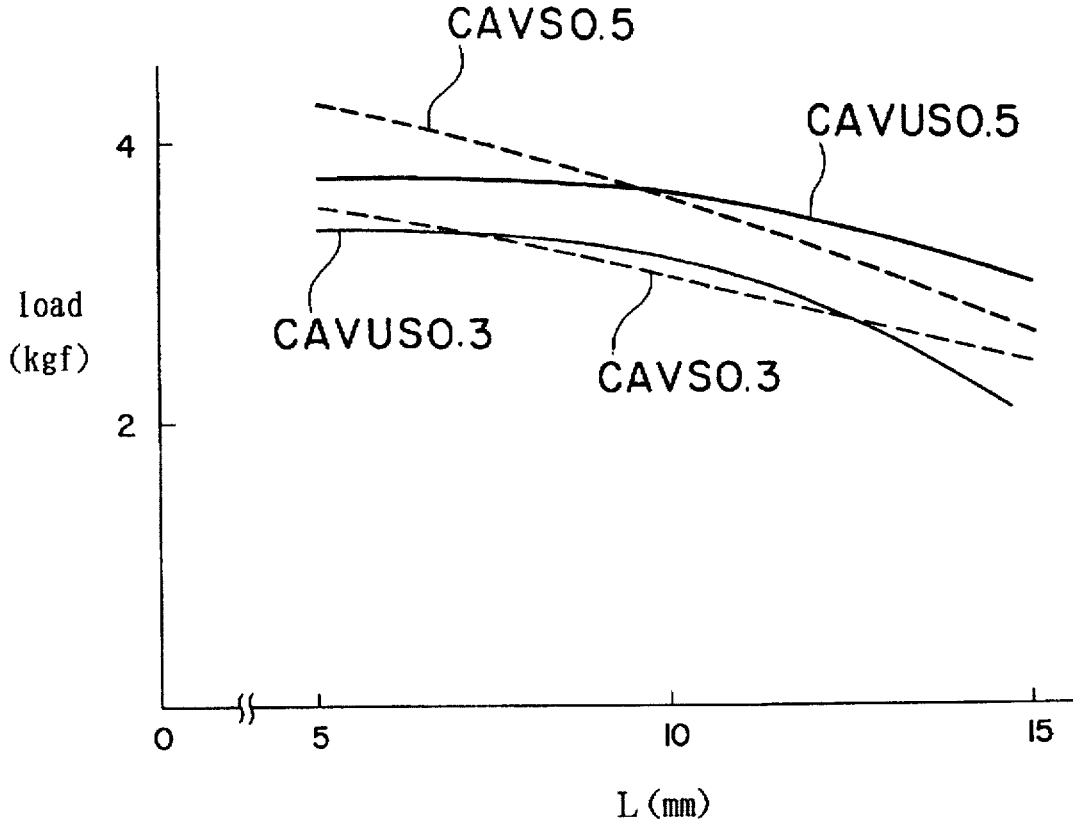
FIG. 5 is a graph showing the relation between the length of various kinds of wires and their buckling load.

FIG. 5 shows the result of measurement representing the relation between the buckling load of various wires 4 and the distance L from the rear end of the terminal 3 to the secondary insertion claws 6. The wires tested are fine wires 4 having conductor cross sections of 0.3 mm2 and 0.5 mm2, each covered with a thick and a thin insulation. The result shown represents averages of three measurements. It is seen from the diagram that at the grip position L=15 mm, the wire 4 will buckle with less than 3 kgf (about 29N).

Hence, for wires that are used with high frequency for automatic insertion (conductor cross section may exceed 0.5 mm2), setting the grip position L for the secondary insertion claws 6 to 15 mm or greater (for wires with 0.5 mm2 or larger in cross section) will result in the buckling at around 3 kgf or less. The larger the wire diameter, the harder it becomes for the wire to buckle and the longer the dimension L needs to be set. When the wire 4 buckles, an excess load (overload) acting on the terminal 3 and connector housing 24 is absorbed by the slacked portion 4*a* of the wire 4 (FIG. 4) preventing breakage of the terminal 3 and the connector housing 24 caused by improper insertion of the terminal during the secondary insertion process (such as abutting between the terminal 3 and the connector housing 24).

Generally, in the combination of a non-waterproof connector housing 24 and a terminal 3 with no waterproof plug, the load required for terminal insertion is 1.5 kgf (about 14N) or less. Hence, by setting the buckling load at around 3 kgf, the terminal 3 can be reliably inserted normally. The L=19–31 mm in the above embodiment satisfies the condition of L=15 mm or greater.

With the above terminal insertion method, because the wire 4 buckles when subjected to excess load, there is no need to set an overload value for each terminated wire 2 and connector housing 24, as is required in the conventional technique, in securing appropriate escape forces for varying sizes of the terminated wire 2 according to the length L represented by the required terminal insertion stroke L1 (18–30 mm)+δ (1 mm). Even when the terminal insertion force provided by the secondary insertion claws 6 is set at more than 3 kgf, there is no problem because in the event of an abnormal condition, the wire 4 buckles at lower loads.

Figure 7:
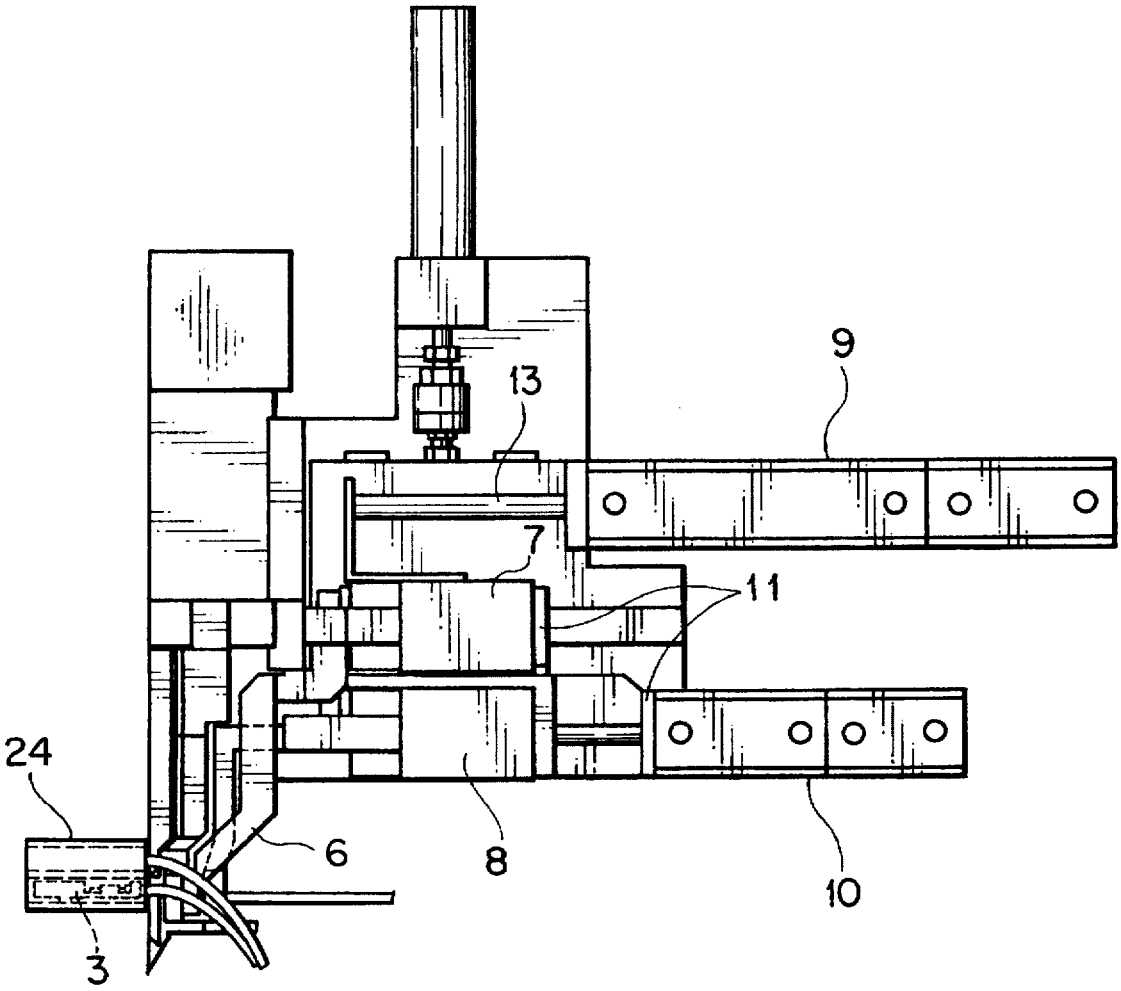
FIG. 7 is a side view showing the apparatus in the secondary insertion process of inserting the terminal by the secondary insertion cylinder.
Figure 8:
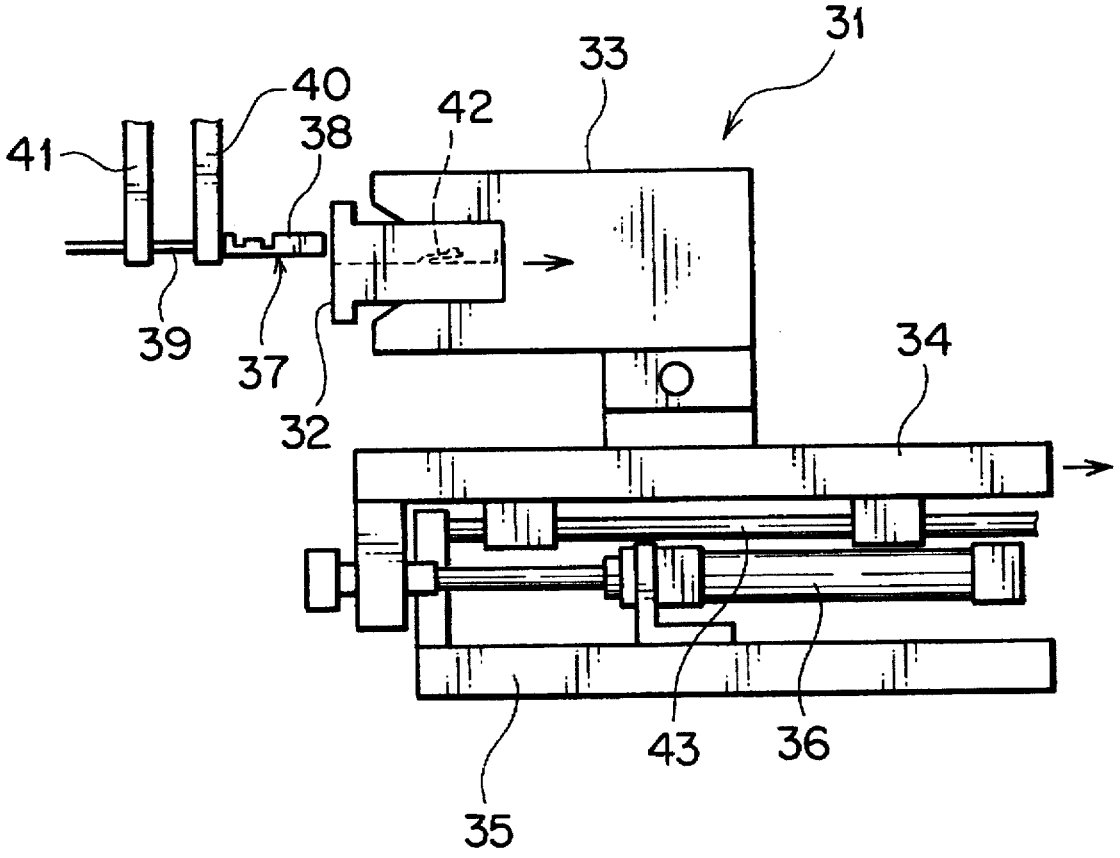
FIG. 8 PRIOR ART
FIG. 8 is a side view of a conventional terminal insertion apparatus.

FIG. 6 shows the terminated wire 2 inserted into the connector housing 24 by the terminal insertion apparatus 1 in the primary insertion process, and FIG. 7 shows the terminated wire 2 in the secondary-inserted state.

In FIG. 6, the primary insertion cylinder 9 extends the most to advance the primary insertion claws 5 and the secondary insertion claws 6 simultaneously. As a result, the front end portion 3*b* of the terminal 3 is inserted into the connector housing 24. Then, with the primary insertion claws 5 open, the secondary insertion cylinder 10 extends as shown in FIG. 7 in the secondary insertion process to advance only the secondary insertion claws 6 to insert the terminal 3 into the connector housing 24.

When a large terminal and a large-diameter wire are used or a waterproof connector housing and a waterproof terminal (having a waterproof rubber plug attached to the rear part thereof) are used, a large terminal insertion force, up to around 5 kgf or about 49N (the maximum value among different kinds) as opposed to the normal terminal insertion force of about 1.5 kgf, is required. A large-diameter wire does not easily buckle and may not be able to apply the insertion method that utilizes the above-mentioned buckling.

To deal with this problem, a second terminal insertion method sets the pressure of the primary insertion cylinder 9 in the terminal insertion apparatus 1 of FIG. 1 and FIG. 6 and 7 to 3 kgf (29N), and the pressure of the secondary insertion cylinder 10 to 5 kgf (49N), higher than the pressure of the primary insertion cylinder 9. The pressure of the primary insertion cylinder 9 (3 kgf) is equal to the buckling load of wire as mentioned above (3 kgf), and the pressure of the secondary insertion cylinder 10 (5 kgf) is equal to the maximum insertion force (5 kgf) of large-diameter wires and waterproof terminated wires.

Setting the pressure of the primary insertion cylinder 9 smaller than the pressure of the secondary insertion cylinder 10 can reduce the force acting on the terminal 3 and the connector housing 24 and thereby eliminate the possibility of the terminal being broken even if the front end of the terminal strikes the front end 24*a* of the connector housing 24 when the front end portion 3*b* of the terminal is inserted into the connector housing 24 in the primary insertion process by the primary insertion cylinder 9 as shown in FIG. 6. The primary insertion process does not require a large force because what is inserted in the primary insertion process is only the front end portion 3*b* of the terminal 8.

At the same time, when the terminal 3 abuts against the resilient locking lance and fails to be inserted during the insertion of the entire terminal by the secondary insertion cylinder 10 in the secondary insertion process as shown in FIG. 1, the primary insertion cylinder 9 is compressed to absorb excess force preventing the breakage of the terminal.

That is, as described by referring to FIG. 1, because the secondary insertion cylinder 10 for moving the secondary insertion claws 6 independently is fixed to the guide plate 11, because the primary chuck cylinder 7 for the primary insertion claws 5 is secured to the guide plate 11 and because the rod 13 of the primary insertion cylinder 9 is connected to the primary chuck cylinder 7, if the secondary insertion cylinder 10 pushes the terminal 3 which stuck halfway in with excess force (more than 3 kgf), a reactionary force causes the rod 13 of the primary insertion cylinder 9 to move in the opposite direction (rearward), compressing the primary insertion cylinder 9 to release the overload with the result that no excess force acts on the terminal 3 and the connector housing 24.

When the terminal 3 is inserted normally, the wire 4 between the terminal 3 and the secondary insertion claws 6 buckles and deflects to some extent and there is no possibility of an excessive force acting on the terminal. Even when the required insertion load for the terminal 3 is large, because the terminal 3 is inserted in one stroke by the secondary insertion claws 6 and the inertia of the secondary chuck cylinder 8, the primary insertion cylinder 9 is not compressed thus assuring reliable terminal insertion.

As described above, by buckling the wire as claimed in claim 1, the overload produced in the event of a failure of the secondary insertion can be absorbed. Further, by setting the pressure of the primary insertion cylinder smaller than that of the secondary insertion cylinder as claimed in claim 2, the overload produced in the event of a failure of the secondary insertion can be absorbed by the primary insertion cylinder, making it possible to prevent breakage of the terminal and connector housing reliably without having to set an overload value according to the size of the terminal and the diameter of the wire as is required with the conventional technique.

Having now fully described the invention, it will be apparent to one of ordinary skill in the art that many changes and modifications can be made thereto without departing from the spirit and scope of the invention as set forth herein.

What is claimed is:

1. A terminal insertion method comprising:

gripping a wire with a terminal with front and rear insertion claws;

inserting a front end portion of said terminal into a connector housing in a primary insertion step; and inserting the whole terminal into said connector housing with said rear insertion claws in a secondary insertion step;

wherein a distance from a rear end of said terminal to said rear insertion claws is set slightly greater than the stroke of said rear insertion claws required for inserting the whole terminal into the connector housing in said secondary insertion step, and when said terminal interferes with said connector housing during the secondary insertion step, the wire between said rear end of the terminal and said rear insertion claws is made to buckle to release an overload acting on said terminal and said connector housing.

2. A terminal insertion method according to claim 1, wherein the distance from said rear end of the terminal to said rear insertion claws is the required insertion stroke of said rear insertion claws plus a margin for preventing interference between said front insertion claws and said terminal.

3. A terminal insertion method according to claim 2, wherein the required insertion stroke of said rear insertion claws is in the range of 18 to 30 mm, and said margin is 1 mm.

4. A terminal insertion method employing a terminal insertion apparatus which comprises:

front and rear insertion claws with which a wire with a terminal is gripped;

a primary chuck cylinder for opening and closing said front insertion claws;

a primary insertion cylinder having a rod thereof connected to said primary chuck cylinder;

a secondary chuck cylinder for opening and closing said rear insertion claws;

a secondary insertion cylinder having a rod thereof connected to said secondary chuck cylinder; and a guide plate having both said primary chuck cylinder and said secondary insertion cylinder secured thereto;

wherein said secondary chuck cylinder is movable independently of said primary chuck cylinder, said method comprising the step of:

setting a pressure of said primary insertion cylinder smaller than that of said secondary insertion cylinder so that an overload acting on a terminal and a connector housing when the terminal interferes with the connector housing during a secondary insertion step is released to said primary insertion cylinder.

5. A terminal insertion method according to claim 4, wherein the pressure of said primary insertion cylinder is set to 3 kgf, and the pressure of said secondary insertion cylinder is set to 5 kgf.

* * * * *